United States Patent [19]

Hölzl

[11] Patent Number: 4,917,399

[45] Date of Patent: Apr. 17, 1990

[54] LONG DISTANCE SKI BINDING

[75] Inventor: Klaus Hölzl, Vienna, Austria

[73] Assignee: TMC Corporation, Switzerland

[21] Appl. No.: 150,644

[22] PCT Filed: Jun. 4, 1987

[86] PCT No.: PCT/EP87/00288

§ 371 Date: Dec. 18, 1987

§ 102(e) Date: Dec. 18, 1987

[87] PCT Pub. No.: WO87/07845

PCT Pub. Date: Dec. 30, 1987

[30] Foreign Application Priority Data

Jun. 23, 1986 [AT] Austria ..... 1706/86

[51] Int. Cl.[4] ..... A63C 9/18

[52] U.S. Cl. ..... 280/615; 73/862.02; 280/809

[58] Field of Search ..... 280/611, 612, 809, 615, 280/614; 73/862.02

[56] References Cited

U.S. PATENT DOCUMENTS

| | | | |
|---|---|---|---|
| 4,135,728 | 1/1979 | Salomon | 280/605 |
| 4,309,760 | 1/1982 | D'Antonio | 280/612 |
| 4,311,321 | 1/1982 | Svoboda | 280/611 |
| 4,382,611 | 5/1983 | Salomon | 280/615 |
| 4,740,009 | 4/1988 | Hoelzl | 280/602 |

*Primary Examiner*—David M. Mitchell
*Assistant Examiner*—Eric Culbreth
*Attorney, Agent, or Firm*—Finnegan, Henderson, Farabow, Garrett & Dunner

[57] ABSTRACT

A cross-country ski binding provided with a holding device for holding, optionally with elastic resiliency, an extension of a ski boot which is to be held in the binding, or of the sole of said boot, and with a heel plate. In order to make it possible in a binding of this kind to display the steps made or the push-off force applied, provision is made to provide in a manner known per se a measurement transducer (30) which responds to forces and produces electrical signals and which is connected to an evaluation circuit (31) controlling a display device (33), the measuring transducer being disposed in the holding device (10) or in or beneath the ball plate (7) or the heel plate in order to protect is against damage.

8 Claims, 8 Drawing Sheets

LONG DISTANCE SKI BINDING

BACKGROUND OF THE INVENTION

The invention relates to a cross-country ski binding provided with a holding device for holding, optionally with elastic resiliency, an extension of a ski boot which is to be held in the binding, or of the sole of said boot, and further provided with a ball plate against which the sole of the ski boot comes to bear during skiing, and with a heel plate.

A binding of this kind was disclosed by U.S. Pat. Specification No. 4,512,594. In this known binding the elastically resilient holding device allows safety release.

In these and similar bindings, in which the elastically resilient holding does not permit safety release but serves only to facilitate skiing, it is often desirable, for example for the purpose of monitoring performance training or the like, for the steps made or the push-off force exerted for the individual steps to be displayed.

SUMMARY OF THE INVENTION

The aim of the invention is to propose a binding of the kind defined above which enables the steps made and/or the push-off force exerted to be displayed.

According to the invention this is achieved by the provision in a manner known per se of a measuring transducer which responds to physical magnitudes and produces electrical signals and which is connected to an evaluation circuit controlling a display device, the measuring transducer being disposed in or beneath the the ball plate or heel plate or else in the holding device of elastically resilient construction.

Through these measures it is possible to determine the steps made and/or the push-off force thereby exerted, while the suggested locations of the measuring transducer enable very simple constructional solutions to be achieved and the measuring transducer is to a large extent protected against damage.

If the measuring transducer is disposed in a ball plate, it is possible to determine, at least approximately, the number of steps made, and also to measure the push-off force. Arrangement of the measuring transducer in the heel plate results in a particularly simple construction, although this enables only the number of steps but not the push-off force to be determined.

When the measuring transducer is disposed in the resilient holding device it is possible to accommodate all the components of the apparatus according to the invention in a small space, while exposed connecting wires can be avoided.

The physical magnitudes to which the measuring transducer responds may be forces or else distances travelled by parts of the measuring transducer which move when the skier makes a step, or angular relationships. However, travel pickups of this kind can also be used to determine forces. In this case the force acting on a part monitored by the travel pickup can be determined from measurement of the distance travelled and knowledge of the spring constant of that part.

Through the measures proposed it is possible, depending on the design of the evaluation circuit, to display the steps made or the push-off force exerted in making those steps. It is then possible in every case to determine the corresponding values from the signals of the measuring transducer which correspond to the forces exerted.

In the French Patent Specification No. 2 510 898 it has already been proposed to provide in a downhill ski binding an electronic display device indicating the initial stress of the catch spring. This however enables only the holding force of the binding under existing conditions at the time to be known. In particular, variations of the release forces, for example caused by a layer of snow, or of the adjustment values can be ascertained thereby.

According to another feature of the invention, provision may be made for the evaluation circuit to be in the form of an integrator, which is preceded by a threshold switch and which integrates the signals of the measuring transducer which exceed a determined value. In this way the number of steps made can be determined because each step entails the application of a corresponding, even if in certain circumstances small, push-off force or else the bending of the foot, thus bringing about a variation of the distance between a part of the boot and the ski or a variation of the angle between the sole of the boot and the ski.

According to another feature of the invention provision may be made for the evaluation circuit to be in the form of a peak value store which detects the pressure peaks occurring on each step and which can be reset on every fall of the signals of the measuring transducer to a value close to zero. This type of evaluation of the signals coming from the measurement transducers permits monitoring of the push-off force exerted on each step, thus also enabling the training performance of a sportsman to be correspondingly monitored. This also permits the radio transmission of those values to a display.

Another development according to the invention consists in making the measuring transducer in two parts, one of which is disposed in or on the ball plate or heel plate while the other is disposed on the main body, or else one part is disposed on the catch and the other part on the spring or on the holding bow. A permanent magnet is used for the one part and a Hall probe or other sensor responding to a magnetic field for the other part. With an arrangement of this kind the push-off force exerted on each step can also be determined, at least approximately.

In a particularly preferred embodiment of the invention provision may be made for the display device to be connected to a selector switch permitting changeover of the display mode.

BRIEF DESCRIPTION OF THE DRAWINGS

The invention will now be explained more fully with reference to the drawings, in which.

DETAILED DESCRIPTION OF THE PREFERRED EMBODIMENT

Figure 1:
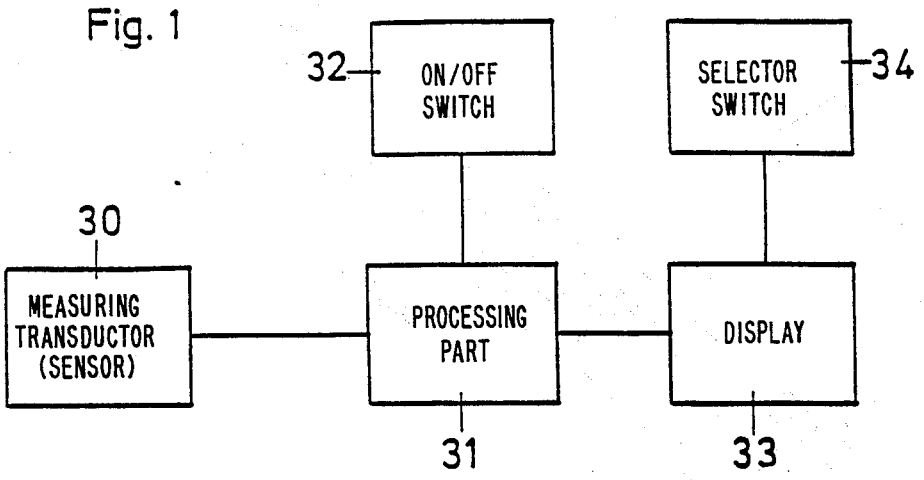
FIG. 1 is a block circuit diagram of the apparatus according to the invention.

FIG. 1 shows a block circuit diagram of an apparatus for displaying the steps made or the pressure peaks occurring on push-off for the individual steps, of the kind used for a binding according to the invention.

This apparatus contains a measuring transducer 30 which converts the forces occurring, or the distances or angular positions occurring between the individual components of a binding, which is provided with an elastically resilient holding device, into corresponding electrical signals. This measuring transducer 30 is connected to an evaluation circuit 31, which in turn can be selectively activated via an on/off switch 32, the latter making the connection to a current source (not shown).

The evaluation circuit 31 is connected to a display device 33, the operating mode of which can be changed over by means of a selector switch 34. The evaluation circuit 31 may expediently consist essentially of an integrator preceded by a threshold switch. In this way the integrator integrates all output signals of the measuring transducer 30 which correspond to the exceeding of the threshold level. This for example enables the steps made to be displayed.

Moreover, the evaluation circuit 31 has a peak value store, which detects the pressure peak occurring because of the push-off from the ski, at every step. The peak value store is resettable upon a drop in the corresponding signals of the measuring transducer 30 to a value close to zero. With an evaluation circuit of this kind the pressure peaks of the individual steps can be detected. Appropriate choice of the operating mode of the display device 33 by means of the selector switch 34 enables these values to be displayed directly. Alternatively, if this is for example desired for monitoring the training of a sportsman, to be transmitted by means of a transmitter (not shown) to a remote display device, which in certain circumstances will still further process these values. These values can then for example be determined over a given period of time. This can of course also be done in the evaluation circuit 31.

Possible arrangements of the measuring transducer 30 on a binding are illustrated in FIGS. 3, 3*a*, 4 and 4*a*. As shown in these figures, a main body 18 of the binding is adapted to be attached to a ski 25.

Figure 2:
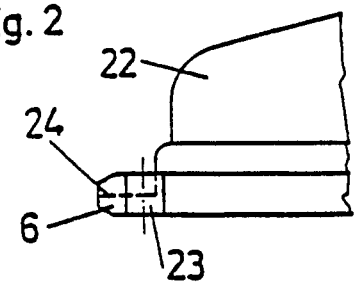
FIG. 2 is a side view of the toe of a boot which is to be fastened.
Figure 3:
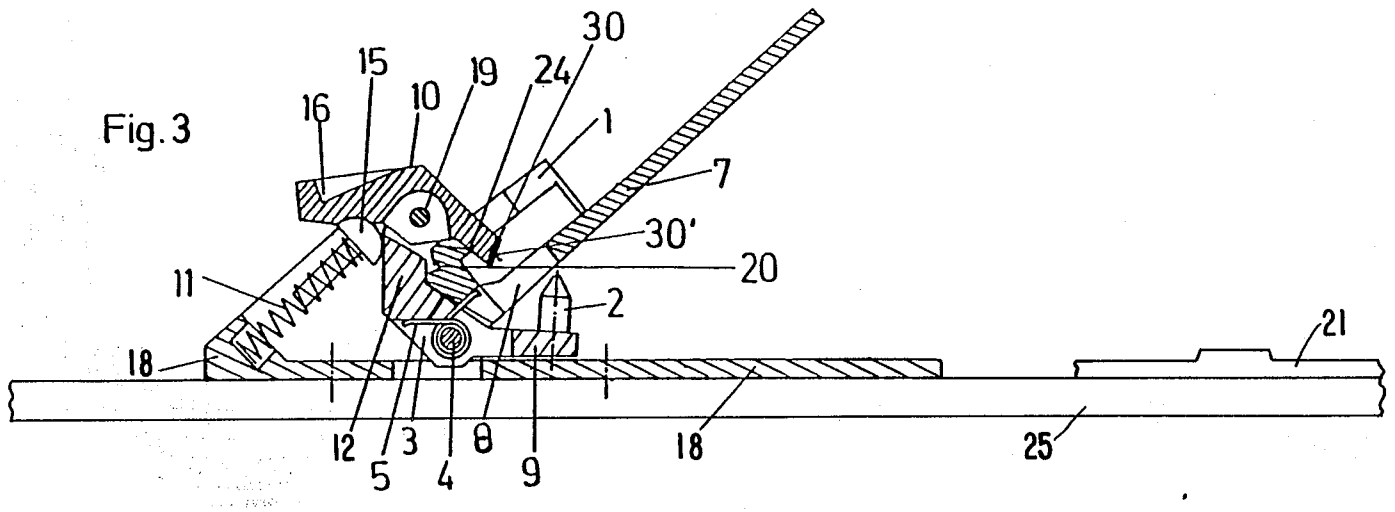
FIG. 3 is a vertical longitudinal section through one example of construction of a binding, in the open position.
Figure 4:
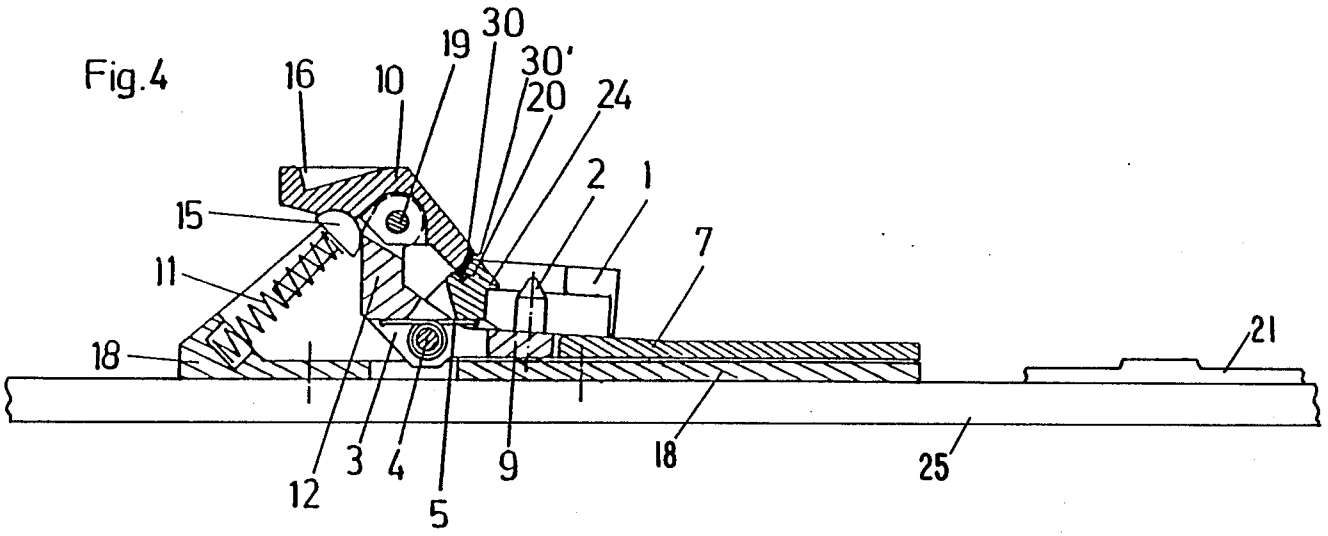
FIG. 4 shows in the closed position the construction shown in FIG. 3, FIGS. 3*a* and 4*a* show a binding corresponding to the construction shown in FIGS. 3 and 4, the measuring transducer simply being disposed in a different position.
Figure 5:
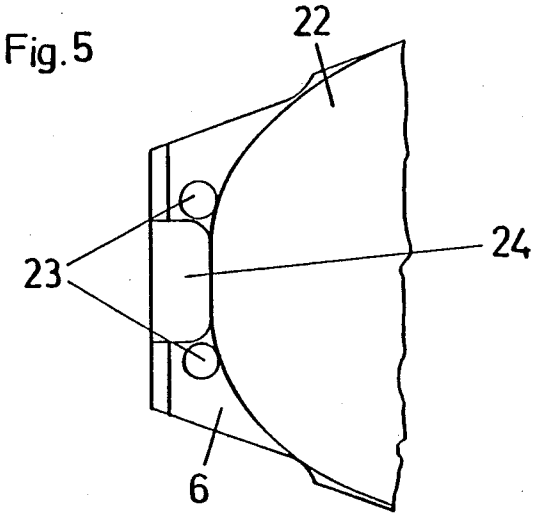
FIG. 5 is a plan view corresponding to FIG. 2.

The binding shown in FIGS. 2 to 6 makes it possible to fasten a boot 22 which is provided only with a relatively short sole extension 6, in which through holes 23 are formed to receive locking pins 2 on the binding (FIGS. 2 and 5).

The binding for fastening a boot of this kind has a holding bow 1 provided with a ball plate 7; it engages over the edge of the sole extension 6 of the boot 22 and thus fastens the boot in the vertical direction. In order to prevent longitudinal and rotary movements of the boot, a pivoting part 3 carrying a locking pin 2 cooperates with the holding bow 1 in a manner which can be seen in particular in FIGS. 3 and 4. Both the holding bow 1 and the pivoting part 3 are mounted on a cross pin 4, while a spring 5, in the form of a leg spring, pivots the holding bow 1 into the upper position shown in FIG. 3 provided that a spring biased holding device 10, which will be described later on, does not prevent this. Under the action of a spring 11, which with the aid of an abutment 15 simultaneously bears against holding device extension 12 of the pivoting part 3 and against a holding device 10, the pivoting part 3 lies against the main body 18 fastened to the ski and carrying the cross pin 4. The catch 10 and the spring 11 also together form the resilient holding device.

For its insertion into the open binding shown in FIG. 3, the boot 22 is pushed obliquely into the holding bow 1, the holding device 10 projecting into the holding bow being released by a corresponding recess 6 in the sole extension 6. Together with the holding bow 1 the boot is then pivoted downwards into the position shown in FIG. 4 and is held fast by the locking pins 2 which pass through the through holes 23 in the sole extension 6. The holding device 10, which is pivotable about the pin 19, thus slides over the edge 24 of the holding bow and is finally secured on the shoulder 20 on the latter. The binding is thus closed and the holding bow 1 and the pivoting part 3, which together hold fast the sole extension 6, are able to pivot upwards about the cross pin 4 against the action of the spring 11.

Figure 3A:
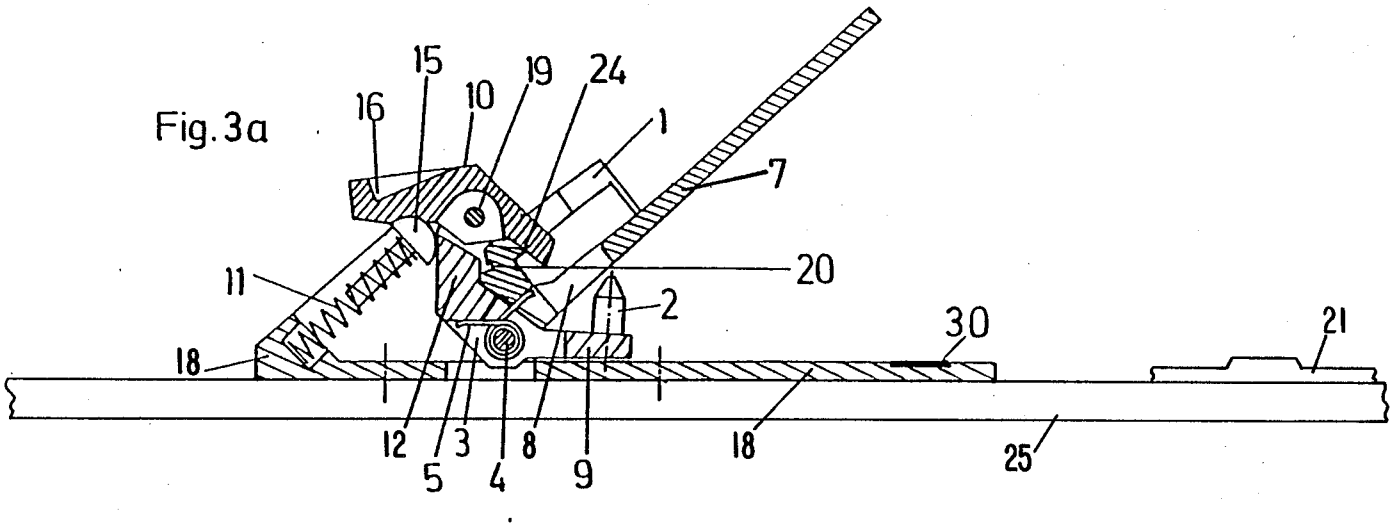
FIG. 3*b* shows a transducer in a heel plate.
Figure 4A:
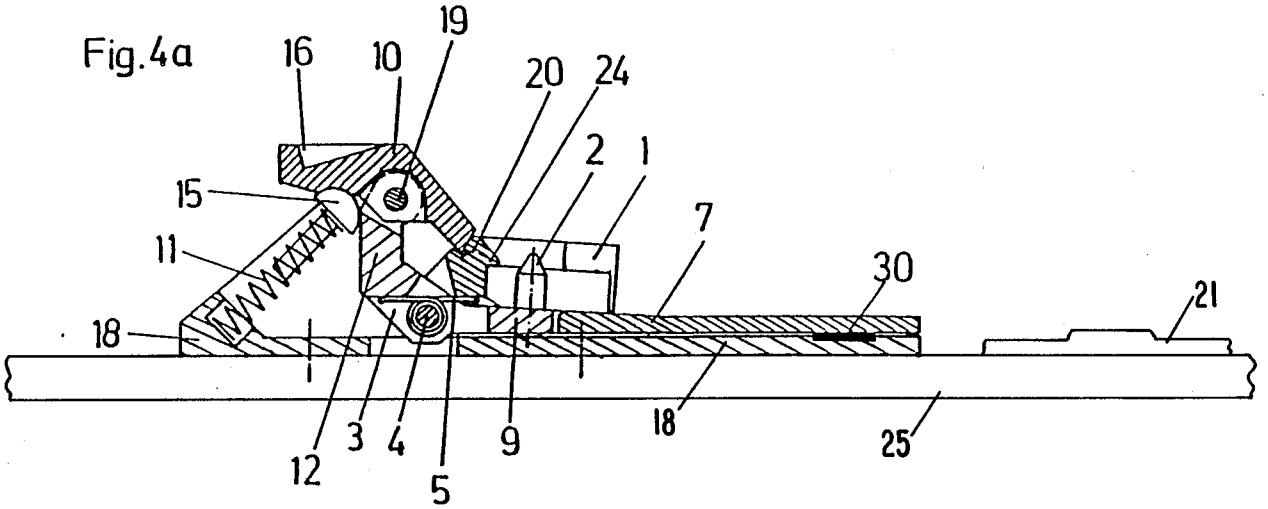

A very favorable arrangement according to the invention for the measuring transducer 30 is the mounting of the latter in the main body 18 in the region of or under the ball plate 7, as shown in FIGS. 3*a* and 4*a*. In this case the measuring transducer 30 is situated in the region of the ball of the foot of the skier. With this arrangement substantially accurate detection of the pressure peaks on push-off from the ski is also possible.

Figure 3B:
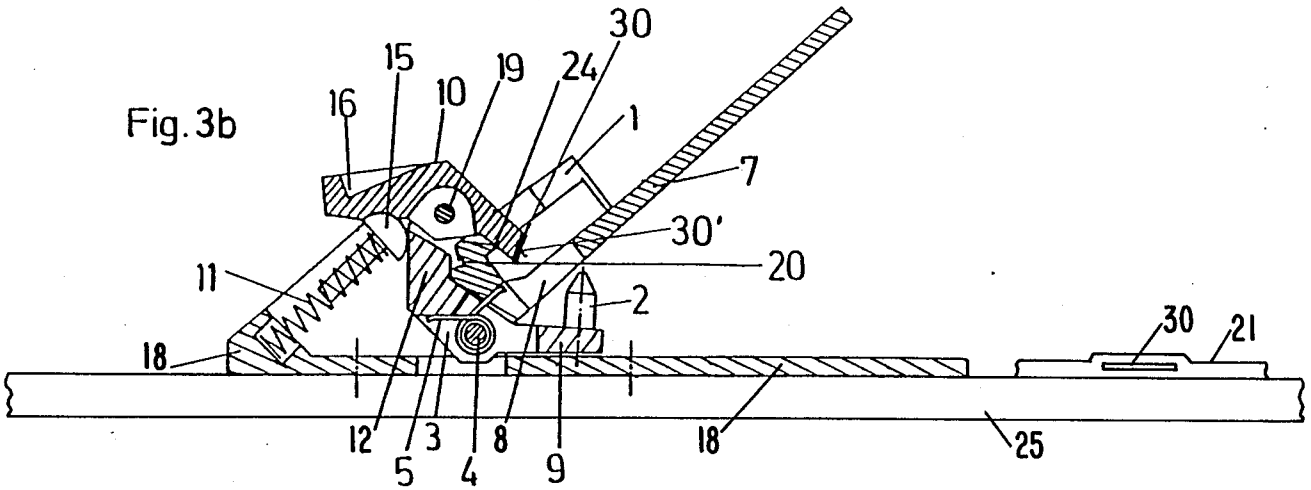

As shown in FIG. 3*b*, the measuring transducer may also be disposed according to the invention under or in the heel plate 21, although an arrangement of this kind is expedient only when information concerning the gliding process is desired. This arrangement differs from that shown in FIGS. 3*a* and 4*a* only in respect of a change of position of the measuring transducer in the longitudinal direction of the ski.

One possible arrangement of the measuring transducer 30 on the resilient holding device is as follows:

In the region of the holding device 10 where the latter engages in the shoulder 20, or in the notch bounded by the latter, or on the end face of the holding device 10 which bounds this region, the measuring transducer 30, for example in the form of a piezoelectric disc, can be secured by adhesive bonding, as shown in FIGS. 3 and 4. The measuring transducer 30 mounted in this manner is expediently covered by a protective disc 30' secured to it by adhesive bonding. When the heel is lifted off the ski, as occurs on every step taken, the pressure on the measuring transducer 30 is increased ad thus its output signal is modified.

A variant of the arrangement of the measuring transducer 30 on the resilient holding device 10 consists in disposing it in the region of the support of the spring 11. It is then possible to use a force pickup, such as for example a piezoelectric force pickup, and a capacitive or inductive position pickup monitoring the movement of the spring 11. The angular position of the pivoting part 3 in relation to the ski surface can thus be determined, but, if the spring constant of the spring 11 is known, the force acting on it can also be determined. With an arrangement of this kind it is also possible to determine, at least approximately, the push-off force exerted on each step.

In addition, although not shown provision may also be made for the measuring transducer to be composed of two parts. Thus, for example, the measuring transducer may be composed of a small permanent magnet and, for example, of a Hall, probe or other sensor responding to a magnetic field. One of these two parts can be disposed in the ball plate 7 and the other in the main body 18, or else one part is disposed on the holding device and the other part on the spring or on the holding bow. When the boot is lifted off the ski surface, as is done when a step is taken, this leads to a variation of the distance between the two parts of a measuring transducer of this kind, so that its output signals are modified.

For the purpose of opening the binding, it is only necessary to apply an appropriate force to the depression 16 in the holding device 10, for example by means of a ski pole, thereby pivoting the holding device 10 out of the shoulder 20 of the holding bow 1. The holding bow 1 is then pivoted upwards until the locking pins 2 no longer project into the openings 23.

Figure 6:
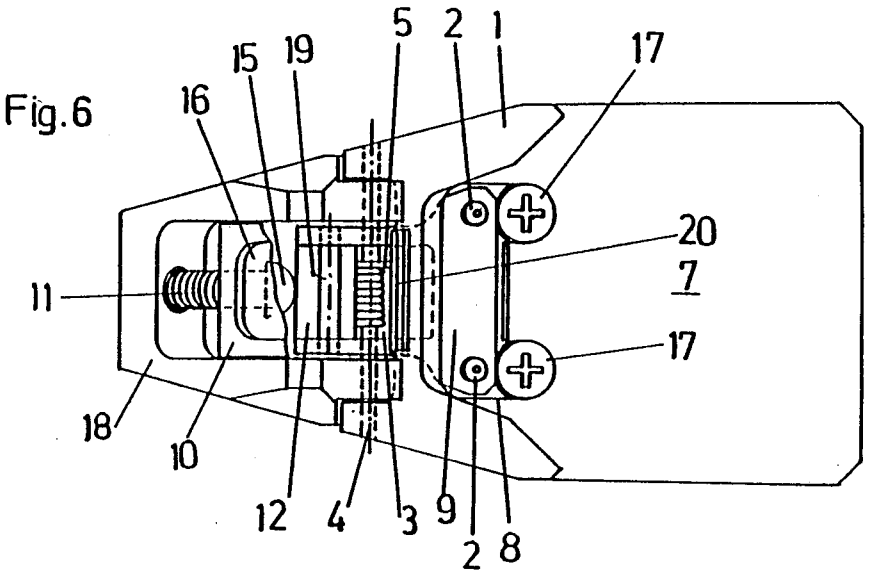
FIG. 6 is a plan view corresponding to FIG. 4, the catch being partly omitted.

As shown particularly in FIGS. 4*a* and 6, it is possible to hold the above-described binding quite close to the ski by providing the ball plate 7 of the holding bow 1 with a cutout 8 through which the plate-shaped portion 9 of the pivoting part passes when the binding is in the closed position. The screws 17 securing the main body 18 to the ski, the pivoting part and the measuring transducer 30 disposed in the main body 18 do not then make it necessary for the boot to be at a greater distance from the ski than that corresponding to the thickness of the bottom part of the main body 18 and of the ball plate 7 of holding beam.

I claim:

1. A cross-country ski binding comprising:

a main body adapted to be attached to a ski;

a ball plate mounted on the main body for supporting the ball ~~of~~ a ski boot;

a heel plate mounted on the main body for supporting the heel of the ski boot;

holding means mounted on the ball plate for holding said ski boot on said main body;

transducer means for detecting the pressure applied to the ski and for generating electrical signals in response to the pressure;

an evaluation circuit, coupled to said transducer means, for evaluating said electrical signals generated by said transducer means;

a display device, coupled to said evaluation circuit, for displaying one of a first operating mode indicative of the number of steps traveled by the ski, and a second operating mode indicative of the force applied to the ski during a push-off phase of each of said steps; and a selector switch, coupled to said display means, for selectively switching said display device between said first operating mode and said second operating mode.

2. A cross-country ski binding according to claim 1, wherein said transducer means is provided in said ball plate.

3. A cross-country ski binding according to claim 1, wherein said transducer means is provided on said holding means.

4. A cross-country ski binding according to claim 1, wherein said evaluation circuit comprises integration means for integrating said electrical signals which exceed a first predetermined value.

5. A cross-country ski binding according to claim 1, wherein said evaluation circuit comprises a peak value store unit for detecting and storing peaks of said electrical signals and for resetting the peak value when said electrical signals fall below a second predetermined value.

6. A cross-country ski binding according to claim 1, wherein said transducer means comprises a magnet and a magnetic sensor, said electrical signals varying in response to the distance between said magnet and said magnetic sensor.

7. A cross-country ski binding according to claim 1, wherein said heel plate is mounted on the ski rearwardly of the main body.

8. A cross-country ski binding according to claim 7, wherein said transducer means is provided in said heel plate.

* * * * *